United States Patent [19]

Boillot

[11] 4,072,814

[45] Feb. 7, 1978

[54] FURNACE FOR MELTING METAL BY THE JOULE EFFECT

[75] Inventor: Pierre Gérard Boillot, Le Pecq, France

[73] Assignees: Institut de Recherches de la Siderurgie Francaise Irsid, Saint-Germain-en-Laye; Instruments S.A., Ivry-sur-Seine, both of France

[21] Appl. No.: 685,049

[22] Filed: May 10, 1976

[51] Int. Cl.[2] ..... H05B 3/40

[52] U.S. Cl. ..... 13/20; 13/25

[58] Field of Search ..... 13/20, 23, 25, 22, 31

[56] References Cited

U.S. PATENT DOCUMENTS

| | | | |
|---|---|---|---|
| 2,679,545 | 5/1954 | Kistler | 13/20 |
| 2,945,756 | 7/1960 | Ballantine | 13/25 X |
| 3,155,759 | 11/1964 | Marshall | 13/20 X |
| 3,160,693 | 12/1964 | Palmer | 13/20 X |
| 3,636,229 | 1/1972 | Sitek et al. | 13/25 |

*Primary Examiner*—R. N. Envall, Jr.

*Attorney, Agent, or Firm*—Haseltine, Lake & Waters

[57] ABSTRACT

A furnace for melting metal by the Joule effect to enable extraction of gases contained in the metal comprising a hollow tubular body which constitutes a heater resistor clamped between two electrodes, and a separate crucible for the metal which is supported within the tubular body and out of direct contact with the electrodes.

3 Claims, 9 Drawing Figures

FURNACE FOR MELTING METAL BY THE JOULE EFFECT

FIELD OF THE INVENTION

The present invention relates to the analysis of gases contained in a solid metal and more particularly to means employed for melting the metal with a view to releasing the gases.

PRIOR ART

It is known that metallurgists attach great importance to the most accurate knowledge possible of the amounts of gases, e.g. hydrogen, oxygen, nitrogen, etc., contained in metals, because these elements have a decided influence on the properties of the metals. In order to carry out measurement of these gases it is first necessary to extract them from the metal by bringing the metal to a very high temperature. It is essential to aim at very high temperatures because certain metals such as tungsten to be analyzed have very high melting points, and equally because part of the gases may be found in the form of combinations, nitrides, for example, which must be decomposed in order to release the gas from them.

Melting of this kind is currently obtained by introducing a crucible containing the metal into an electrically heated furnace. The heating may be effected by induction, by electric arc or by Joule effect. In this last case the crucible is clamped between two watercooled metal electrodes connected to a source of power, for example, a low voltage transformer capable of producing high currents, often higher than 1000 amps. The crucible which has a certain resistivity is traversed by the current and brought by Joule effect to a temperature, which may reach 2000° to 2300° C, which causes melting of the metal in the crucible.

In fact this technique is far from being entirely satisfactory and has certain inadequacies which limit its possibilities considerably, above all as far as analytical applications are concerned. One of the inadequacies is connected with the conditions of use and concerns the clamping of the crucible between two electrodes in order to obtain electrical contact. Actually the forces required to obtain correct flow of the current are not negligible, which leads to the use of graphites, which have good mechanical strength at high temperature, for producing the crucibles. However, the type of graphite which satisfies these mechanical demands has the defect of not being very porous and of being difficult to de-gas. The result is that the gases released, being unable to diffuse through the walls of the crucible, are constrained to pass through the molten metal contained in the crucible, to produce numerous splashings towards the electrodes to establish electrical contact. This phenomenon assumes, of course, the greater the size the greater the mass of metal introduced into the crucible, which produces a limitation on the size of the sample and excludes the proportioning of very low gas contents. In addition, this technique does not allow the degassing of the crucible under identical operational conditions with an empty crucible and a crucible containing metal. This is explained by the fact that the electrical resistance of the crucible is not the same in both cases. In the absence of metal, the crucible has a certain resistance which conditions the flow of the current and hence finally the temperature reached. When the crucible contains metal this "wets" the walls, thus constituting a kind of shunt and the entirety exhibits a lower resistance. A current of higher intensity then flows through the crucible and the conditions are no longer comparable with those obtained with an empty crucible. For example, with an empty crucible a current of 600 amps may flow and with the same crucible containing 1 gram of metal a current of 800 amps flows when the metal is molten. With larger quantities there is even the risk of causing destruction of the electric power supply. Finally, it is to be observed that the temperature obtained in the crucible is not homogeneous, a distinctly lower temperature being found at the bottom of the crucible because of its contact with a cooled electrode.

SUMMARY OF THE INVENTION

An object of the present invention is to correct these disadvantages and provide means for reaching high and homogeneous temperatures of the crucibles whatever the amounts of metal employed.

It is another object of the invention to provide a device for melting a metal by the Joule effect to enable extraction of the gases which the metal contains, the device comprising

- a hollow tubular body constituting a heater resistor,
- two electrodes between which said tubular body is clamped, and
- a crucible for metal, said crucible being made of a material which is a good heat conductor and being contained entirely within said tubular body with the walls of said crucible not in direct contact with said electrodes.

The total height of said crucible is less than the minimum internal height of said hollow tubular body and its maximum diameter is at most equal to the internal diameter of said tubular body. To improve the performance of the device it may include, arranged concentrically outside said tubular body, a thermal screen the maximum height of which is less than the maximum height of said tubular body.

In a particular embodiment, said tubular body has an internal shoulder upon which said crucible rests, said tubular body may have one or two bearing surfaces for said electrodes consisting of one or two internal or external flanges arranged at one or both of the ends of said hollow tubular body. The thermal screen may likewise have an internal flange for enabling centering with respect to said hollow tubular body.

As will be understood, the invention consists of a device in which two elements have independent functions.

The crucible is no more than a receptacle for metal, the function of heating devolving upon a specialized separate member, the tubular body. This dividing of the functions enables the inadequacies of the known devices to be corrected and performances to be achieved which have never before been obtained with Joule-effect analysisfurnaces. Thus, with the heating being effected by Joule effect in an element independent of the crucible, the temperature effects obtained are always identical whether the crucible contains metal or not. Further, the tubular element which has to withstand the clamping forces may be produced from graphite of high mechanical strength but relatively low porosity without causing splashing of metal since the crucible, which is itself no longer subjected to mechanical stress, may be manufactured from a more porous graphite which degases easily. Consequently, it becomes possible to melt variable and large amounts of metal which may reach several grams, which enables the measurement of gases reduced to a trace. It is equally possible to institute a number of successive heatings of the crucibles in the presence of metal in order to check the complete extraction of the gases, since the heating element remains unchanged.

BRIEF DESCRIPTION OF THE DRAWINGS

The invention will be more fully understood from the description of embodiments thereof, given by way of example only, with reference to the accompanying drawings. In the drawings.

DETAILED DESCRIPTION

Figure 1:
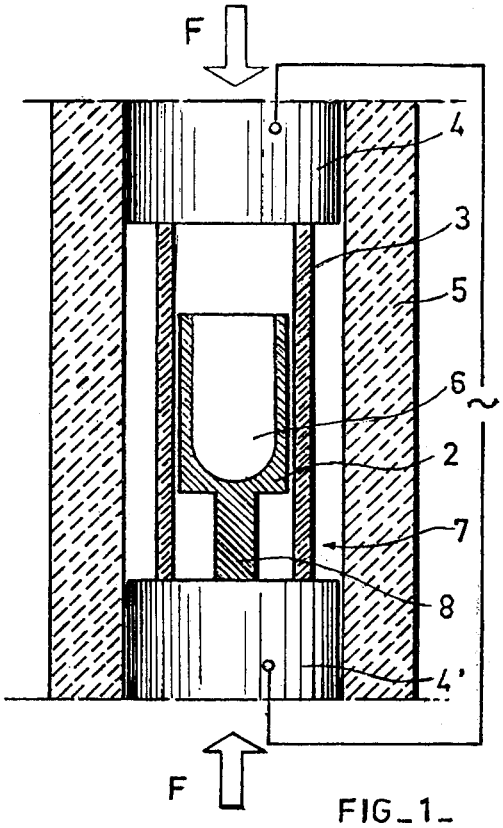
FIG. 1 is a section through an embodiment according to the invention including a crucible and heater element.

As shown in FIG. 1, the device comprises a crucible 2 in a hollow tubular body 3 of cylindrical shape constituting an element for heating by Joule effect. The current is brought to the heater element 3 by means of two planar electrodes 4 and 4' upon which forces F are exerted in order to ensure good electrical contact with the element 3. The device includes an envelope 5 which is of a generally cylindrical shape. The gases released by metal 6 in the crucible 2 during the course of melting of the metal are extracted and driven out of the chamber 7 of the device by known means which are not shown. It will be observed that the crucible 2 includes a stud 8 having a double function. On the one hand the stud 8 has a length such that the crucible is located at the level of the hottest zone in the chamber 7 and on the other hand the stud is of reduced section to avoid a large surface of contact with the lower electrode 4'. The concept of this construction is aimed, of course, at substantially eliminating all the factors which might contribute to lowering the temperature obtained in the crucible. The electrodes 4 and 4' are made of metal and cooled by water-circulation in order to avoid their deterioration and hence constitute cold poles. Consequently, there appears within the heater element 3 a zone of maximum heating equidistant from the two electrodes 4 and 4' and it is most desirable to locate the metal close to this zone. Moreover if a crucible were employed whose entire bottom surface rested against the face of the electrode 4', the bottom of the crucible would be cooled and the temperature of the metal would be lowered. Experience has shown that with conventional crucibles clamped directly between the two electrodes, temperatures of the crucible bottom are obtained which for a current of 600 amps are:

— crucible with a flat bottom laid on the electrode . . . 1100° C

— crucible with its bottom separated 1800° C from the electrode by 5 millimeters — crucible with its bottom substantially spaced from the electrode . . . . 2800° C Hence it can be seen that it is most desirable to raise the bottom of the crucible and to restrict the area of contact with the cold electrode. In order to alleviate the disadvantages proceeding from direct heating of the crucible by Joule effect, such as splashing of metal, excessive restriction upon the mass of metal, variation of the heating conditions with and without metal, an independent heater element is employed which remains foreign to or is unaffected by the modifications in state occurring in the crucible. The independent heater element 3 consists in its simplest form of a hollow cylindrical body made, as far as this example is concerned, of a graphite of high mechanical strength clamped directly between the electrodes 4 and 4'. It will be observed that the height of the cylindrical body 3 is greater than that of the crucible 2 and that the current can flow only in the walls of this cylinder 3 which plays the part of a heating resistor. The crucible located inside the body 3, the dimensions of which in the present case are such as to obtain a free fit without play in the body of the cylinder, is heated by radiation and by conduction. Experience has shown that far from restricting the temperature reached, this assembly enables temperatures of the order of 3000° to 3500° C to be reached in the crucible and hence melting of metals such as tungsten can be obtained.

Furthermore, with the crucible made of a graphite which de-gases well, there is no splashing of metal and, without disadvantage, masses of metal may be melted, equal to or greater than 6 g instead of the 1g constituting the limit for ordinary devices. This increases the possibility of measuring traces of gas in the metals.

Figure 2:
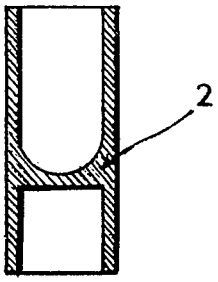
FIG. 2 is a section through another embodiment of the crucible of FIG. 1.

As regards the principle of raising the bottom of the crucible and minimum contact of the crucible with the cold surface of the lower electrode, other crucible shapes may be envisaged, such as that shown in FIG. 2.

Similarly the shape of the cylindrical element may be more complicated and can assume various shapes such as are shown in FIGS. 3 to 6 as regards the requirement that no part of the crucible should interrupt the continuity of the cylindrical body between the electrodes.

Figure 3:
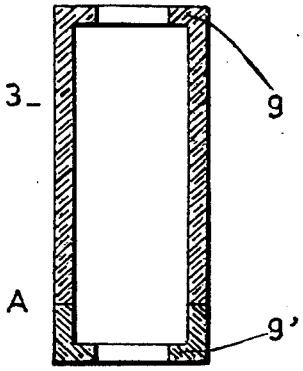
Figure 5:
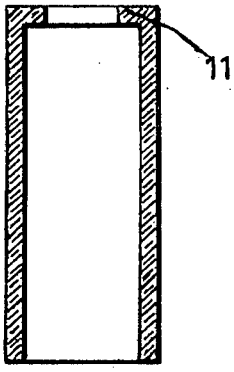
Figure 4:
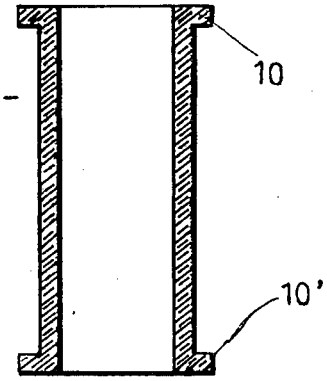
Figure 6:
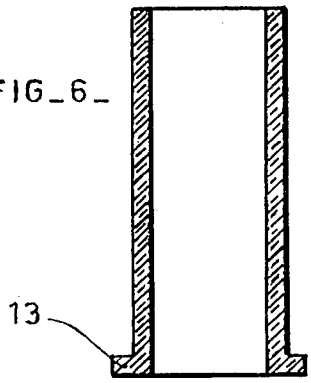

Symmetrical shapes of the element 3 may be envisaged, such as shown in FIGS. 3 and 4, having internal flanges 9, 9' or external flanges 10, 10', to increase the areas of contact with the electrodes, or asymmetrical shapes, such as shown in FIGS. 5 and 6, having a single internal flange 11 or external flange 13 capable of being located at the top or at the bottom of the element. In the case of FIG. 3 it is to be understood that machining conditions require that one of the ends be removable and fitted afterwards, for example at the level A, to the cylindrical body.

Figure 7:
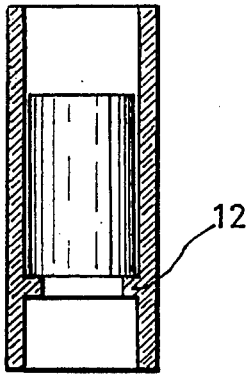
FIGS. 3, 4, 5, 6 and 7 show different embodiments of the heater element of FIG. 1.

In FIG. 7 the cylindrical body has an internal shoulder 12 on which the crucible bears. In this embodiment the stud 8 of the crucible is omitted and consequently there is no longer any contact of the bottom of the crucible with the lower electrode. Attention is again drawn to the fact that in all these embodiments the current flows solely in the walls of the cylindrical body 3 and the streamlines thereof are not interrupted by any part of the crucible. Consequently, the heating conditions are always identical, the strength of the current flowing through the heater body remaining the same under all circumstances.

It must likewise be observed that with the above described device each of the components of the device can be made of the material which best meets the problem of melting. For example, crucibles of refractory materials such as alumina, silica . . . may be employed depending on requirements, and the heating element be made of a metallic material or a suitable alloy.

Figure 8:
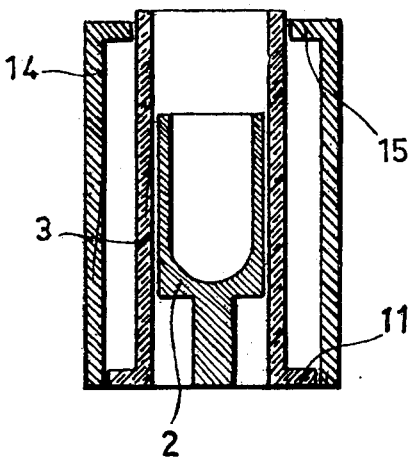
FIG. 8 is a section through an embodiment including a thermal screen.

With the aim of further raising the melting temperature, part of the heat diffused towards the outside of the heating element may be recovered. For this purpose, the cylindrical element 3 is surrounded as shown in FIG. 8 by a cylindrical thermal screen 14 which acts as a reflector with respect to the walls of the envelope 5 which it protects from too high a temperature. Actually in view of the very high temperatures reached, deterioration of these walls under the effect of the heat may be feared. Hence the screen 14 has the double purpose of insulating the walls of envelope 5 from the thermal radiation and of concentrating the heat towards the central body. Under these conditions temperatures of 3500° C are regularly reached. FIG. 8 shows an assembly comprising a crucible 2, a cylindrical heater element 11 and a thermal screen 14. It will be observed that the height of the protective screen 14 is such that the cylindrical element 11 projects slightly thereabove in order that the screen, like the crucible, cannot constitute a path for the flow of electric current, this being constituted exclusively by the cylindrical element. The protective screen has at least one flange 15 (FIGS. 7 and 8) which enables centering of the screen with respect to the cylindrical body. It is obvious that one can provide, using cylindrical elements of various shapes and thermal screens of different types, numerous assemblies meeting the purpose proposed.

Figure 9:
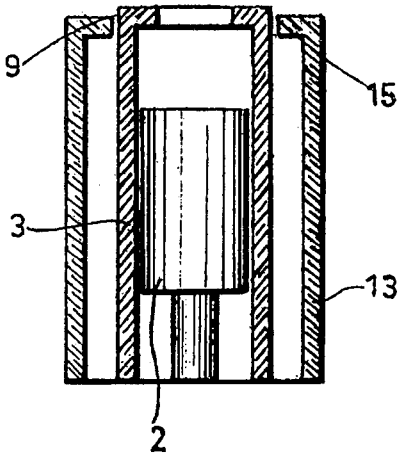
FIG. 9 is a section through another embodiment.

By way of practical example, the dimensions will now be given of a unit, such as that shown in FIG. 9, produced from graphite.

The crucible produced from a graphite exhibiting a certain porosity has a total height of 25mm which comprises a receptacle height of 20mm and a stud height of 5mm. The outer diameter is 10mm, the inner diameter is 8mm and the inside height is 19mm. The cylindrical heater body has an inner diameter of 10mm, an outer diameter of 12mm and a total height of 32mm. The inside height of the body taken from below the flange is 29mm, and the inner diameter of the flange is 7mm. The thermal screen has a height of 30mm and an inside height from below the flange of 24mm. Its outer diameter is 22mm and its inner diameter is 18mm. The inner diameter of the flange is of course of the order of 12mm to allow the cylindrical body to pass through. As already stated, the tolerances with respect to the dimensions given above are determined so that the crucible can be introduced into the cylindrical heater body as a free fit but without play.

The respective dimensions of the various elements enable crucibles to be employed which can melt, without splashing at high temperatures, 10g of metal.

As is clearly apparent from the preceding description, the above described devices enable measurement of trace gases to be contemplated because of the possibilities of increasing the mass of the sample and achieving highly reproducible heating conditions, whatever the conditions of the contents of the crucible.

What is claimed is:

1. A device for melting a metal by Joule effect to enable extraction of the gases which the metal contains, said device comprising:

a hollow, tubular, vertical body constituted of graphite having high mechanical resistance and constituting a heater resistor, an upper and a lower heating electrode between which said tubular body is clamped, and a crucible of heat-conductive, porous material disposed in the interior of the hollow body and in open electrical circuit with said electrodes, said crucible being hollow for containing metal to be melted and having a bottom for said metal, and means for positioning said bottom above the lower electrode in thermal isolation therewith.

2. A device as claimed in claim 1 wherein the graphite of said crucible has great porosity, said means for positioning the bottom of the hollow crucible above the lower electrode comprising a projection extending from said crucible and resting on said lower electrode to support the crucible therefrom, said projection being of reduced section compared to said bottom.

3. A device as claimed in claim 2 wherein the graphite of said crucible has great porosity, said means for positioning the bottom of the hollow crucible above the lower electrode comprising an internal shoulder on said hollow body intermediate the ends thereof, said crucible resting on said shoulder.

* * * * *